US005456628A

United States Patent [19]

Csabai

[11] Patent Number: 5,456,628

[45] Date of Patent: Oct. 10, 1995

[54] USE OF SPECULAR HEMATITE AS AN IMPACT MATERIAL

[76] Inventor: Julius S. Csabai, 22 Normandy Road, Baie D'Urfe, Quebec, Canada, H9X 3E6

[21] Appl. No.: 132,420

[22] Filed: Oct. 6, 1993

Related U.S. Application Data

[63] Continuation-in-part of Ser. No. 957,836, Oct. 8, 1992, abandoned.

[51] Int. Cl.[6] ..... B24C 1/00

[52] U.S. Cl. ..... 451/36; 451/39; 51/307

[58] Field of Search ..... 451/36, 38, 39, 451/40; 51/293, 307

[56] References Cited

U.S. PATENT DOCUMENTS

| | | | |
|---|---|---|---|
| 3,939,613 | 2/1976 | Ayers | 451/38 |
| 4,035,962 | 7/1977 | Ayers . | |
| 4,038,380 | 7/1977 | Cordon | 51/308 |
| 4,089,943 | 5/1978 | Roberts et al. | 51/308 |
| 4,110,083 | 8/1978 | Benedict | 51/295 |
| 4,115,076 | 9/1978 | Hitzrot, Jr. | 51/295 |
| 4,258,505 | 3/1981 | Scheiber et al. | 451/103 |
| 4,279,962 | 7/1981 | Meyer et al. . | |

FOREIGN PATENT DOCUMENTS

| | | |
|---|---|---|
| 3637558 | 5/1988 | Germany . |
| 50-083481 | 7/1975 | Japan . |
| 58-114862 | 7/1983 | Japan . |
| 1432351 | 4/1976 | United Kingdom . |
| 8102539 | 9/1981 | WIPO . |

OTHER PUBLICATIONS

International Search Report, PCT/CA93/00426, Mar. 24, 1994.

International Search Report, PCT/CA93/00426, Jan. 20, 1994.

Database WPI, Week 8333, Derwent Publications Ltd., London, GB; AN 83–737886 & JP,A,58114862 (Kawasaki Steet KK), 8 Jul. 1983, see abstract.

Database WPI, Week 7604, Derwent Publications Ltd., London, GB; AN 76–06195 & JP,A,50083481 (Teijin KK), 5 Jul. 1975, see abstract.

Database JAPIO, Japan Patent Information Organization, AN 83–114862,JP,A,58114862 (Kawasaki Steel Corp.), see abstract.

Database WPAT, Derwent Publications Ltd., AN 88–127250, DE,A,3637558 (Sarval SA), see abstract.

*Primary Examiner*—Maurina T. Rachuba

*Attorney, Agent, or Firm*—Ronald S. Kosie; Robert Brouilette

[57] ABSTRACT

The present invention relates to the use of specular hematite particles as an impact material and in particular as an impact material for treating a surface by dry blasting.

18 Claims, No Drawings

USE OF SPECULAR HEMATITE AS AN IMPACT MATERIAL

This is a continuation-in-part application of U.S patent application No. 07/957,836 filed on Oct. 8, 1992, abandoned.

The present invention relates to a material and a process for using the material as an impacting or blasting material for the treatment of a surface. The invention in particular relates to an impact material which may be used in place of sand or other known types of non-metallic or metallic blasting abrasives in order to blast clean the surface of an object, e.g. such as an object made from a ferrous metal material such as for example iron metal or a ferrous alloy.

It is known to treat a surface of an article by blasting the surface with a particulate impact material. In accordance with this type of treatment, the particulate impact material is hurled at the surface at high velocity in a jet comprising a fluid carrier and impact (or abrasive) grains or particles.

Sand, for example, has in the past been commonly used to remove paint or rust from a surface for cleaning or for preparing it for repainting; hence the term "sandblasting". The impact (abrasive) sand particles may be contacted with the surface of an article as a suspension in a high pressure stream of a gas such as, for example, compressed air, (i.e. impacting is by a dry blasting process).

Although sand has been used as an impact material for treating (i.e. cleaning) the surface of an object or workpiece, it has a high breakdown rate when impacted or impinged at high velocity on a surface which is being blast cleaned. As a result large amounts of dust may be produced which can not only contaminate the surface being cleaned and but also present an environmental hazard (i.e. an air pollutant) for the operator(s) of the blasting equipment; i.e. inhalation of such dust can lead to the debilitating disease commonly known as silicosis. Metal (e.g. ferrous) surfaces coated with silica dust must be further treated to remove the dust otherwise painting over the silica dust may lead to inadequate wetting of the surface by the paint and lead to inadequate fixing of the paint to the surface which may in turn lead to premature lose of the coating.

Various types of alternate material (metallic and non-metallic) are known for use as impact or blasting particles to replace sand; see, for example, U.S. Pat. Nos. 4,832,706, 3,939,613, 4,947,591, 4,190,422, 4,035,962 and 4,115,076.

It is, for example, known to use spherical glass beads or steel shots to accomplish blast cleaning by peening action upon impingement. Such spherical particles are especially adapted for being recycled due to their high impact strength but have other disadvantages. For example, due to their spherical shape, these type of particles are used to best advantage when projected perpendicularly to the surface area of the work piece, otherwise the particles have a tendency to roll off tangentially without accomplishing any surface penetration. Additionally, steel shot type impact or blasting media is also known to strike sparks upon impact on steel or iron workpieces. The sparking phenomenon may present a considerable hazard at outdoor steel structure cleaning jobs when dry paint removal is being done.

At the other end of the spectrum, it is known to use impact particles which have irregular and sharp shapes. Such particles may be derived from various material such as, for example, copper/nickel slags, aluminum oxide, steel grit, as well as from some naturally occurring minerals such as olivine, syenite, nepheline, flint, etc.. These types of impact materials (with sharp edges) may be used to create rough surfaces (i.e. surface anchor patterns) to which coatings (like primers, paints, and various metal deposits) can be attached most efficiently. However, when a surface, and particularly a metal (e.g. iron or steel) surface, is blast cleaned using sharp edged impact particles, such particles may dig into the surface and become embedded therein or rebound outwards and not only leave an undesirable surface indentation but also bring some of the treated metal out and above the surface. Thus chips of sharp minerals and slags may leave behind inclusions on a treated surface (e.g. of softer metals such as for example aluminum, brass and copper). Such inclusions are not desirable since they may impair the quality of a subsequently applied coating(s).

Attrition dust, resulting from the impact of an abrasive media on a surface, will commonly not only project dust into the work environment putting the blasting system operator(s) at a health risk but also leaves a certain amount of dust deposit on a workpiece after every blast cleaning. If this dust deposit has any free iron content the dust layer, in the presence of even a low level of atmospheric humidity, may not only itself quickly corrode so as to create an undesirable rust layer but may also undesirably accelerate corrosion of the treated surface of iron based articles. This latter type of premature corrosion may present a problem with respect to the outdoor treatment (e.g. for repainting) of metallic (e.g. ferrous) objects such as bridges, vessels and the like which are near bodies of water where fog and high air humidity are common and where air humidity control is not possible.

It is common, for example, to blast treat a bridge structure prior to (re)painting it. Such treatment is carried out for the purpose of providing a bare metal surface for painting and commonly involves the removal of an old paint coating and/or the removal of any rust from the surface to be (re)painted. However, there is usually a time delay between the treatment of the surface of a bridge structure and the application of a paint coating to the surface thereof; if there is such a time delay, and the bridge surface is unprotected or has an iron metal dust layer deposited on it, any such time delay will increase the chances of undesirable humidity triggered premature corrosion.

An iron metal or rust dust layer may be left behind by impact particles such as those comprising steel shots, chilled iron grits, etc.; a man made composite iron metal/iron oxide impact material is, for example, taught in U.S. Pat. No. 4,115,076. The deposit of such an iron metal or rust layer on a steel or iron workpiece may also be facilitated by the action of magnetic type forces (i.e. fields). Other known impact (abrasive) materials may also leave behind a corrodible dust layer. If paint is applied over adhering corroded (or corrodible) particles such as rust, the results may be an inferior coating. When a cleaned surface is a non-ferrous metal (such as aluminum or brass), "free iron" may also result in undesirable galvanic action.

Military and civilian shipyards have turned to the use of impact material made from slags for cleaning vessels, etc.; these slags include coal boiler slag as well as metallurgical slags. However, slag based impact particles may have a relatively high heavy metal content (e.g of arsenic, beryllium, cadmium, cobalt, lead, mercury, copper and zinc). The presence of such heavy metals has raised concerns about the health hazard to workers due to their presence; many heavy metals are either labelled or suspected to be carcinogens. Copper content of slags is particularly undesirable; it has been reported to cause galvanic corrosion on the substrate of blast cleaned steel surfaces.

Due to the pressure of health and environmental agencies in various countries, blasting operators may be required to collect and safely dispose of used blasting material and also any material removed from the surface of a blast treated object. The reusability of any chosen blasting media has thus taken on greater importance and along with this so has the ease with which the impact media may be separated from the removed particles (e.g. removed particles of paint, rust, mill scale and the like). For example, the higher the specific gravity of the blasting media, the easier it becomes separable from the removed particles by air washing by baghouse vacuuming action.

Slags (or other equal value impact minerals, like: silica sand, flint, olivine, garnet, etc.) may have a relatively low specific weight and as such have relatively low resistance to side drifting forces of blowing wind when the cleaning operations are being carried out outdoors (at most construction site works). Accordingly, these types of impact particles do not for this reason easily lend themselves to recycling in an exposed outdoor environment.

Accordingly, there is a continuing search for impact (abrasive) particles with which to replace sand and other known impact (abrasive) particles.

It would be advantageous to have a material which may be used for high velocity impact treatment of surfaces (hard) and which may have a relatively high resistance to disintegration on impact.

It would be advantageous to have a material which may be used for high velocity impact treatment of surfaces (hard) and which may be effectively recirculated for re-use.

It would be advantageous to have a material which may be used for high velocity impact treatment of surfaces (hard) and which may have a relatively high cleaning rate.

It would be advantageous to have a material which may be used for high velocity impact treatment of surfaces (hard) and wherein the use thereof may be accompanied by a relatively low dust production.

It would be advantageous to have a material which may be used to leave a non corrodible dust layer on the surface of an object.

In accordance with a first aspect the present invention generally relates to the use of particles of specular hematite as an impact material. This impact material may, for example, be used to treat the surface of metallic and/or non-metallic objects.

In accordance with a particular aspect the present invention provides a method of treating a surface of an article comprising impacting the surface with impact particles, characterized that the impact particles are contacted with said surface by dry blasting and in that the impact particles comprise particles of specular hematite.

The particles of specular hematite may be projected, in any known manner, so as to impact the surface of an object, i.e. at a (high) velocity sufficient to treat the surface of an object in the desired fashion such as, for example, to remove surface material, to texturize the surface, to peen the surface, etc.

The impact particles may comprise specular hematite in combination with one or more other types of (known) impact or abrasive materials such as for example impact particles of aluminum oxide, glass beads, etc. However, in accordance with a further particular aspect of the present invention, the impact particles may consist of particles of specular hematite, i.e. the impact material may be based solely on specular hematite.

In accordance with the present invention, the impact particles of specular hematite used may, for example, have a size of +16 mesh sieve sizes, (sieve sizes are Canadian standard sieve series 8-GP-1u which is identical to U.S.A. sieve series ASTM specs. E-11-87); the specular hematite particles may take on any particle size which reflects its function as an impact material. The specular hematite particles may, for example, have a size be in the range of from 16 to +200 mesh. If other (known) types of impact particles are present they may have the same or comparable particle size as the specular hematite particles. The particle size distribution of the impact particles used in any particular situation may vary as desired. For example, a relatively coarse specular hematite material may be used to remove heavy contaminants such as scale while a relatively finer impact material may be used to remove mild rust or treat a soft metal object; the impact material may of course as desired be some combination of fine and course particles.

It is to be understood herein, that if a "range" or "group of substances" and the like is mentioned with respect to a particular characteristic of the present invention, the present invention relates to and explicitly incorporates herein each and every specific member and combination of sub-ranges or sub-groups therein whatsoever. Thus, any specified range or group is to be understood as a shorthand way of referring to each and every member of a range or group individually as well as each and every possible sub-ranges or sub-groups encompassed therein.

For example, with respect to mesh size, the specular hematite may have a mesh size in the range of from 16 to 200 mesh. The reference to a mesh size in the range of from 16 to 200 mesh is to be understood as specifically incorporating herein each and every individual mesh size as well as sub-ranges, such as for example 16 to 40 mesh, 50 mesh, 80 to 200 mesh, 16 to 35 mesh, 35 to 50 mesh, 50 to 80 mesh, etc.; similarly with respect to any other ranges for temperature, concentrations, elements, etc.

The particles of specular hematite possess a particularly advantageous combination of properties, including a more or less oblong grain configuration, high density, high hardness, etc.. Specular hematite has, for example, a high specific gravity of 4.9–5.4 and an exceptional hardness number which ranges from 6½ to 7 on the Mohs scale.

As mentioned, the specular hematite particles of the present invention have a relatively high specific gravity (e.g. 5.4). They are, as a result, especially effective as impact (abrasive) particles for the removal of surface contaminants (e.g. paint, rust, etc.). At particle velocities such as, for example, from 121 to 188 m/sec (for particles of from 16 to 80 mesh size), the specular hematite particles generally do not undercut the surface nor too deeply penetrate the surface of an object such as a ferrous metal object. Thus, unlike chips of sharp minerals and slags (of most metal oxides) which often leave inclusions behind on the treated surfaces (of softer metals, like: aluminum, brass and copper), the relatively blunt particles of specular hematite do not create the same embedment problems, which would otherwise impair the quality of a coating. It is to be understood, however, that, for any given velocity if an object of a soft non ferrous metal (such as aluminum or copper) is to be impacted, it is generally preferable that the particles be of a size smaller than if the object is of a harder ferrous metal, i.e. to inhibit undesired scoring of the surface of the softer metal. A smaller size particle will have a lower kinetic energy to dissipate on impact than a larger size particle moving at the same velocity.

The particles of specular hematite also have an exceptionally good breakdown resistance. In this respect, it has been found that recycled specular hematite impact material has a relatively high impact breakdown rate number (see below).

In accordance with a further particular aspect of the present invention, it has been found that if the impact specular hematite material starts out with particles having a relatively coarse grain size of 50 mesh or larger (e.g. a mesh size of from about 16 to from 40 to 50), the proportion of such coarse particles will more or less stabilize after the impact material has been recycled one or more times. A major proportion of such recycled grains have been found to have a mesh size of around the 50 mesh size or more and this notwithstanding attrition due to dust production, i.e. the impact grains which are most populous on stabilization are those at about 50 mesh size which typifies the average magnitude of the strongest crystal formation. It has also been found the specular hematite crystals break off from the larger grains in a distinct fracture pattern. This feature is important in blast cleaning operations because after each repetition of hard surface impacting the remaining specular hematite grain maintains its cleaning efficiency. Therefore the initial particle size before use may advantageously comprise those in the size range of, for example, 50 mesh or larger (e.g. of from 16 to 50 mesh).

Although specular hematite has a high resistance to impact disintegration, some attrition dust is produced. However, dust is produced at a relatively, significantly lower dust production level than as compared to known impact materials (see the examples below). Moreover, since specular hematite has a relatively high specific gravity, the specular hematite dust, as well as the coarse residual particles of specular hematite, left after impact, have a natural tendency to fall to the ground in the immediate area of the work piece rather than be blown about or drift away in air currents (e.g. in the wind at outdoor sites) as is the case for impact materials of lower specific gravity such as impact materials based on slags or other equal value impact minerals, such as silica sand, flint, olivine, garnet, etc.. Thus, advantageously, a relatively small dust cloud is produced when using the specular hematite; as an additional benefit the view of the work piece is less obscured during blasting.

The characteristic high breakdown resistance coupled with the relatively high specific gravity (e.g. 5.4) of specular hematite facilitates the recycle of impact (abrasive) specular hematite particles for reuse as well as the separation from lighter contaminating particles removed from the surface of the workpiece; recycling may be achieved by any (known) manner, e.g. air vacuuming followed by air/gravity separation of the desired specular hematite particle from the rest of the vacuum recovered material.

As indicated above, a relatively a small dust cloud is produced when using the specular hematite for (air) blasting. Therefore, a dust layer may be deposited on the surface of a workpiece. As mentioned above, it is important that any dust deposited on the surface of an object not have any free iron content since this could induce corrosion in the presence of even a low level of atmospheric humidity. This consideration is particularly critical at outdoor projects (like bridge rehabilitations and other structural works) where air humidity control is not possible. Specular hematite, advantageously, contains no such "free iron" such that the deposit of a specular hematite dust layer on the surface of a workpiece does not lead to this type of premature induced corrosion.

Although some specular hematite dust is produced during blasting, such dust may, moreover, be advantageously exploited as hereinafter described.

In accordance with a second aspect of the present invention, it has been found that specular hematite dust has a surprising hydrophobic character. The reason for this hydrophobic character is not fully understood. However, it has been found that a residual hydrophobic dust layer or coating of this impact material left behind on a surface, after blasting, inhibits rusting of the surface (e.g. of a ferrous metal object) prior to the application thereto of a coating (i.e. prior to painting thereof). It is to be understood herein that a reference to a "hydrophobic dust" layer, coating and the like is a reference to a dust layer on the surface of an object on which water will bead rather than wet the particles and underlying surface.

Thus, in accordance with the second aspect, the present invention, generally relates to the use of a hydrophobic dust material for coating a surface (e.g. an impact blasted surface) of an object (e.g. a ferrous metal object), the dust material comprising specular hematite. The hydrophobic dust material may, for example, comprises particles of specular hematite having a size smaller than 400 mesh (or 38 microns). The specular hematite dust may be exploited not only as a by-product of the blasting itself, using an impact material consisting of specular hematite, but alternatively as an additive to an impact blasting material, the dust of which does not possess this quality. As a further alternative, specular hematite dust may be separately applied directly, in any suitable (known) manner (e.g. by a powder spray, manual spreading, etc.) to any surface (e.g. ferrous) which is to be protected from corrosion in the presence of humidity, fog and the like, e.g. immediately after blasting or other type of surface (cleaning) treatment.

In accordance with a particular hydrophobic dust aspect of the present invention, there is provided a method for treating the surface of a metal object (e.g. for the purpose of eventually, thereafter applying a protective coating such as paint to the surface of the object) comprising contacting said surface with impact particles by dry blasting, characterized in that said method includes applying a hydrophobic dust coating to the dry blasted surface, said dust coating comprising specular hematite. The metal object may, for example, be a ferrous metal object.

In accordance with a further particular hydrophobic dust aspect of the present invention there is provided a method for treating the surface of a metal object (e.g. for the purpose of eventually, thereafter applying a protective coating such as paint to the surface of the object) comprising contacting said surface with impact particles by dry blasting, characterized in that the impact particles comprise particles of specular hematite, and in that a hydrophobic dust coating is left behind on the surface (i.e. the by-product dust coating is not removed from the surface) after the dry blasting, said dust coating comprising specular hematite. Again, the metal object may be a ferrous metal object.

In accordance with this further hydrophobic dust coating aspect of the present invention, the impact particles for blasting may consist of particles of specular hematite. However, it may desired to leave behind the hydrophobic dust layer while at the same time exploiting the characteristics of some other (known) impacting substance.

Accordingly, the impact particles may, if so desired, comprise specular hematite in combination with one or more other types of (known) impact materials such as for example impact particles of aluminum oxide, glass beads, etc., the specular hematite being present in the impact material in a proportion sufficient such that the desired hydrophobic layer is left behind on dry blasting of the surface of an object. In this latter case, the specular hematite may be present in the combination of impact materials as relative coarse particles of a (mesh) size which is the same as or comparable to that of the other impact material(s). Alternatively, as previously mentioned, the specular hematite may be initially added, in a dust form, to a non-specular hematite impact material such that a hydrophobic specular hematite dust layer is left behind after blasting with the particles of this impact material. In either case sufficient specular hematite is to be used so as to produce the desired hydrophobic dust layer.

The water repelling characteristic of specular hematite dust is particularly beneficial when a (blast) cleaned surface is not to be immediately painted. As mentioned above, if the painting of a (blast) cleaned surface, which is normally exposed to the natural elements (i.e. bridges, ship hulls, etc.), is delayed, such a delay increases the chances of humidity triggered corrosion (i.e. of ferrous based objects). A specular hematite dust layer, however, can provide corrosion protection during such a delay period by inhibiting corrosion in the presence of air humidity, fog and the like. Additionally, the hydrophobic dust coating need not be removed from the surface prior to painting with an oil based paint. Laboratory testing of blast cleaned surfaces has shown that the hydrophobic dust layer does not interfere with the quality of the paint coating. Test results of fresh and salt water immersion, and cathodic disbondment (ASTM G-42 mod) showed that specular hematite blast cleaned steel samples have a coating-adhesion quality which is superior to those samples cleaned with silica sand, steel grit and aluminum oxide. However, if desired the dust layer may be removed prior to painting by some suitable means such as wiping, vacuuming, etc.

Sensitivity of blasting media to moisture also controls the type of packaging used to store the impacting media. Silica sand, for example, absorbs moisture very readily; therefore, it requires hermetically sealed bags. With specular hematite on the other hand all this extra care and cost of packaging is not necessary.

Specular hematite (sometimes referred to as Specularite) is a naturally occurring mineral and is one of the known forms of hematite which is a ferric oxide material.

Specular hematite is the purest form of all the hematites consisting of 70% iron and 30% oxygen in a completely inert state.

Specular hematite, in spite of its high iron content, is relatively resistant to the production of sparks due to its inert (or vitrified) state.

Specular hematite particles do not comprise silica in either free form or in chemically bound form. Additionally, in stark contrast to boiler (coal) and metallurgical (copper and nickel oxide) slags, specular hematite is essentially free of heavy metals i.e. it contains low trace amounts of heavy metals. As a result, specular hematite may be used as a relatively environmentally friendly impacting material.

Specular hematite has high resistance to most chemicals. It does not, for example, require any special protection against moisture and water. It does not oxidize, or discolour nor does it dissolve in any commonly used chemicals (with the possible exception of highly concentrated hydrochloric acid and potassium ferrocyanide). Specular hematite is thus a relatively inert impact material whereas an impact material such as is taught in U.S. Pat. No. 4,115,076 is a relatively active material, i.e. the material of U.S. Pat. No. 4,115,076 is active in the sense that it may leave behind a dust layer (free iron and/or rust) which may induce corrosion of a metal object such as a ferrous metal object.

Specular hematite is characterized by a distinct crystalline structure. The crystals of specular hematite are silver grey in colour, and facets composing the crystal structure have a lustre of splendid, brilliant mirror like glitter (hence the latin name of specular). Its crystals take the form of either hexagonal or rhombohedral geometry. Typically, thick and round shapes of hexagonal and rhombohedral specular hematite crystals, surrounded with flat and striated facets, give crystals of this mineral a very compact and stable structure. The overall appearance of individual grains is, on the average, obloidal in shape (more like rough, flattened beads). Because specular hematite crystals are built up similarly to corundum, they also possess extremely high structural strength.

A particularly advantageous characteristic of specular hematite crystals is that they have no cleavage line along which most other crystals tend to fail. When crushed under high force, its crystals fail along random parting lines.

Specular hematite, even in its pulverized form, exhibits complete chemical neutrality which measures 7 on the PH scale of alkalinity and acidity.

While other types of hematite form solid solutions with limonite at about 950 degrees Celsius, specular hematite does not change its crystalline structure until the temperature exceeds 1,360 degrees Celsius. Until this specific fusion temperature is exceeded, specular hematite remains a chemically stable form of ferric oxide no matter how small fragments the particle size breaks down to. For this reason, it is very compatible with all materials that it comes in contact with, and particularly with steel and cast iron. Specular hematite of relatively large crystal size, useful in accordance with the present invention, may be found in an ore body located in the Northern Quebec-Labrador region, about 650 miles north-east from Montreal, Canada; the ore is removed by the open pit technique.

In general any ore, bearing suitable specular hematite crystals or grains, must treated to remove the specular hematite from the surrounding rock matrix, as for example by milling the rock by tumbling, followed by screening and/or other (known) suitable separation techniques. A fraction of suitably sized particles may be derived from the separated material using conventional techniques such as selective screening by size.

For the ore obtained from the above mentioned open pit mine, in the Northern Quebec-Labrador region, the processing plant separating the mineral from the rock matrix, is run by the Quebec Cartier Mining Co. In this plant the mined ore is beneficiated into high grade ore concentrate which is used for steel making. However, when the ore is processed the individual particles of specular hematite are liberated from other waste minerals, in size ranges suitable for the present invention, i.e. the raw concentrate before palletizing.

The raw concentrate from the above Quebec plant may be used directly, since a major if not substantial proportion thereof comprises specular hematite particles having a mesh size of 50 mesh or larger. When this raw concentrate is blown against a solid surface the first time, the impact forces break down the weak cementing bonds that hold any separable grains together. On an average, several additional cycles of repetitious blasting applications may be needed to reach a more or less stabile particle size distribution, i.e. wherein the major proportion of particles have a mesh size of +50. After a certain number of recycling, however, the amount of impact material available for recycle will of course diminish due to a slow disintegration of the particles forming the above mentioned specular hematite dust.

The exploitation of specular hematite, in accordance with the present invention, as indicated above, may thus provide a number of advantages, including the following:

- the high density of the specular hematite allows for the efficient transfer of kinetic energy to a surface;
- the high resistance to breakdown (i.e. fracturation) facilitates recycling of the specular hematite particles for reuse after suitable (conventional) separation from impurities associated with the spent particles after use (i.e. air separation, etc.);

specular hematite dust may be used as a corrosion protection layer;

only a relatively low level of heavy metal may be released into the environment on use of the specular hematite;

etc.

In the examples which follow, the specular hematite used was obtained from the above mentioned Quebec plant. All of the screening analyses were carried out with a "Tylor Ro-Tap" Testing sieve shaker machine, using six Canadian Standard Sieve series (8-GP-1d) and a dust pan. The impact (abrasive) breakdown rates were determined in accordance with the procedure outlined by SSPC (U.S. Steel Structures Painting Council) "Steel Structure Painting Manual" vol 1, pg 51 using the formula:

$$\text{impact breakdown rate} = \frac{\text{sum of percent spent impact material} \times \text{avg. sieve opening}}{\text{sum of percent received impact material} \times \text{avg. sieve opening}}$$

A breakdown rate of 1.0 would indicate that the impact material has undergone no size reduction due to blasting. On the other hand a breakdown rate of 0 (zero) would indicate a large size reduction to dust. Most quality (mineral) impact materials will have a breakdown rate of about 0.6.

The following examples illustrate example embodiments of the present invention.

EXAMPLE 1

The cleaning ability of specular hematite grains was examined by pouring about 30 lbs of specular hematite (of 16 to 40 mesh grade) into a 1.3 cu.ft. capacity CANABLAST G-5 vacuum activated blasting machine of cabinet type (made by CANABLAST CO., Ville d'Anjou, Quebec, Canada). The blasting was done using 90 psig vacuum induced pressure. The blasting was carried out for a period of 30 minutes during which impact particles were recycled to reimpinge the surface of the target. The mixture of air and specular hematite passed through a hand held ceramic nozzle such that the blast of impact particles hit the target which was placed at a distance of about 12 inches to 15 inches from the mouth of the nozzle.

Two types of material were cleaned; a grey epoxy paint coated steel plate and a rust covered steel plate. The steel material was a very popular commercial grade of mild variety, i.e. type A-36 steel.

The specular hematite displayed fast cleaning time to obtain white metal finished surface quality, and in the process the dust generation was at least 30% better than with the top of the line grade aluminum oxide.

After blasting was complete, one of the target plates was dedusted by vacuum, while the other blast cleaned steel plate was left dust covered. Both plates were left unprotected overnight in a very humid (about 94–96% humidity at an ambient temperature of about 20 to 22 degrees celsius) environment.

Surprisingly, the next day, the dedusted plate exhibited a brown reddish rust colouring while the other dust covered plate did not show any signs of atmospheric oxidization. This totally unexpected phenomenon is not totally understood but it is believed to be due to the hematite dust having prevented the water in the air from contacting the freshly cleaned steel surface.

EXAMPLE 2

Specular hematite was blast tested along with two popular blasting media to compare their cleaning rates and dust generation rates; the cleaning rate was measured as the time needed to obtain a "white metal finish" surface quality on the steel plate workpiece. The other blasting media were synthetic olivine (from Les Sables Olimag Inc., Thetford Mines, Quebec, Canada) and aluminum oxide (from Impact (abrasive) Industries Inc., Niagara Falls, N.Y., U.S.A.)

For these tests, a CANABLAST G-5 air pressure activated cleaning apparatus was used (made by CANABLAST CO., Ville d'Anjou, Quebec, Canada). The apparatus was equipped with a hand held ceramic nozzle for manual target handling. The air pressure was set to 105 psig.

The objects to be cleaned were nine pieces of identical (mill quality) hot rolled, A-36 steel plates of 10 ga thickness and 12"×12" size. In order to avoid cross-contamination of different impact media used, the entire blasting apparatus, together with the interconnected baghouse was cleaned out using a high powered shop vacuum after each test.

Thus about 30 lbs of each impact media (of identical particle size namely 16 to 40 mesh grade) was used up in tests run for twenty minutes, of uninterrupted blast cleaning operation (with continuous recycling) The results are indicated in Table 1 below.

TABLE 1

| Impact media | cleaning rate (seconds/sq.ft.) | dust production rate (lbs/20 min.) |
|---|---|---|
| synthetic olivine | 105 sec./sq.ft. | 9 lbs/20 min |
| aluminum oxide | 90 sec./sq.ft. | 3 lbs/20 min |
| specular hematite | 65 sec./sq.ft. | 2 lbs/20 min |

NOTE: As may be seen from Table 1 specular hematite not only has a relatively higher cleaning rate but also a significantly lower dust production rate than the other known impact materials.

EXAMPLE 3

Dust samples were collected for hygroscopic analysis from the tests run in example 2 for each of the impact (abrasive) media used.

A few grams of sample dust produced by each of the impact (abrasive) media of example 2 was placed into a Petri dish. A 1" diameter polyethylene ball was used to form a spherical cavity into the dust surface by impression. A 10 cc glass syringe was used to deposit one water drop into the cavity formed in each separate dust sample.

The water drop was quickly absorbed by the fine dust layers of synthetic olivine and aluminum oxide.

On the other hand, specular hematite dust did not soak up the water at all. Even when more drops were added, into the initial ball of one drop of water, absorption did not take place. When the enlarged water ball was left alone for a while it disappeared by atmospheric evaporation rather than by being absorbed by the specular hematite dust. It was also observed that the water ball would tend to form a thin layer of outside capillary coating of hematite dust in a skin membrane like fashion on its own. This process was accelerated by rolling the ball as the dish was tilted sideways. When a larger hematite dust coated water ball was rolled back and forth, in the same direction, it formed into an oblong shape quite readily without intermixing with the dust, and it remained in that form for a prolonged period of time until the water disappeared by evaporation. Even a water quantity of 5–6 drops in a ball would not create high enough hydrostatic pressure to break through the hematite dust's capillary barrier.

EXAMPLE 4

To compare the hydrophobic property of specular hematite dust with other material, dust samples were prepared from specular hematite, a series of commercial grade blasting media as well as from two other iron ore samples. The dust samples (of +300 mesh) were similarly prepared by pulverization of specular hematite and impact materials based on each of the following substances:

Quartz sand
Nepheline Syenite
Coal (boiler) slag
Copper oxide slag
Nickel oxide slag
Synthetic Olivine
Olivine
Garnet
Steel shot/grit
Glass beads
Aluminum Oxide
Specular Hematite
Hematite (from India)
Magnetite (from Iron Ore of Canada)

Applying the same water drop-test as described above for example 3, none of the other blasting media (or iron ore) dust exhibited the same hydrophobic or water repelling property exhibited by the specular hematite.

EXAMPLE 5

For this test, an initial sample of the specular hematite (16 to 40 mesh) was subjected to a single shot blasting (i.e. once with no recycle), using the procedure analogous to that outlined in example 1. However, there was no recycling of the impact material and a shop size blasting machine model no. CAB 41 from CANBLAST CO. was used. Additionally the jet's inclination to the steel workpiece was set at 45 degrees. The resultant spent impact material was subjected to sieve analysis. The result are shown in Table 2 below:

TABLE 2

| | SIEVE ANALYSIS | |
|---|---|---|
| | % (by weight) Retained | |
| Screen Mesh size | As Initially Received | After Blasting |
| #20 | 11.5 | 3.5 |
| #30 | 27.3 | 11.5 |
| #40 | 34.8 | 22.0 |
| #50 | 20.9 | 41.5 |
| #70 | 3.4 | 9.0 |
| #100 | 1.5 | 7.3 |
| Pan | 0.6 | 5.4 |

Impact Breakdown Rate = 0.9

A number of measurements (i.e. 50) were also taken with respect to the depth of penetration of the impact particles into the workpiece surface and the following results were obtained:

| | |
|---|---|
| Max. Penetration Depth | 85 Microns |
| Min. Penetration Depth | 30 Microns |
| Avg. Penetration Depth | 57.6 Microns |

EXAMPLE 6

For this test, an initial sample of the specular hematite (16 to 40 mesh) was subjected to series of discrete single shot blastings (i.e. an initial sample was blasted once, sampled then recycled for additional blasting a sample being taken after each blasting), using the procedure analogous to that outlined in example 5; after each blasting the spent impact material was recovered in conventional manner using vacuum baghouse techniques and a sample of the spent impact material was subjected to sieve analysis. The results are shown in Table 3 below:

TABLE 3

| | SIEVE ANALYSIS | | | |
|---|---|---|---|---|
| | % (by weight) Retained | | | |
| Screen Mesh size | As Initially Received | 1st Blast | 2nd Blast | 3rd Blast |
| #20 | 1.4 | 0.4 | 0.5 | 0.3 |
| #30 | 20.5 | 6.7 | 3.8 | 2.1 |
| #40 | 37.5 | 14.6 | 10.7 | 5.5 |
| #50 | 31.00 | 62.5 | 74.1 | 66.4 |
| #70 | 6.55 | 2.7 | 2.8 | 8.6 |
| #100 | 2.2 | 3.3 | 2.3 | 3.2 |
| Pan | 0.9 | 9.8 | 5.8 | 13.9 |
| Impact Breakdown rate | | 0.76 | 0.99 | 0.87 |

NOTE: As may be seen from table 3, the particle size distribution stabilized at a major proportion having a mesh size of 50. The Impact breakdown rates were also advantageously very high.

I claim:

1. A method for treating a surface of an article comprising impacting the surface with impact particles, characterized in that the impact particles are contacted with said surface by dry blasting and in that the impact particles comprise particles of specular hematite.

2. A method in accordance with claim 1 characterized in that the particles of specular hematite have a size in a range of from 16 to 200 mesh.

3. A method in accordance with claim 1 characterized in that initially said particles comprise particles of specular hematite having a size in a range of from 16 to 50 mesh.

4. A method for treating a surface of an article comprising impacting the surface with impact particles characterized in that the impact particles are contacted with said surface by dry blasting and in that the impact particles consist of particles of specular hematite.

5. A method in accordance with claim 4 characterized in that the particles of specular hematite have a size in a range of from 16 to 200 mesh.

6. A method in accordance with claim 4 characterized in that initially said particles comprise particles of specular hematite having a size in a range of from 16 to 50 mesh.

7. A method for treating a surface of a metal object comprising contacting said surface with impact particles by dry blasting, characterized in that said method includes applying a hydrophobic dust coating to the dry blasted surface for corrosion inhibition of said blasted surface, said dust coating comprising specular hematite.

8. A method in accordance with claim 7 characterized in that said dust coating comprises particles of specular hematite having a size smaller than 400 mesh.

9. A method in accordance with claim 7 wherein the metal object is a ferrous metal object.

10. A method in accordance with claim 8 wherein the metal object is a ferrous metal object.

11. A method for treating a surface of a metal object comprising contacting said surface with impact particles by dry blasting, characterized in that the impact particles comprise particles of specular hematite, and in that a hydrophobic dust coating for corrosion inhibition of the surface is left behind on the surface after the dry blasting, said dust coating comprising specular hematite.

12. A method in accordance with claim 11 characterized in that said dust coating comprises particles of specular hematite having a size smaller than 400 mesh.

13. A method in accordance with claim 11 wherein the metal object is a ferrous metal object.

14. A method in accordance with claim 12 wherein the metal object is a ferrous metal object.

15. A method for treating a surface of a metal object comprising contacting said surface with impact particles by dry blasting, characterized in that the impact particles consist of particles of specular hematite, and in that a hydrophobic dust coating for corrosion inhibition of the surface is left behind on the surface after the dry blasting, said dust coating comprising specular hematite.

16. A method in accordance with claim 15 characterized in that said dust coating comprises particles of specular hematite having a size smaller than 400 mesh.

17. A method in accordance with claim 15 wherein the metal object is a ferrous metal object.

18. A method in accordance with claim 16 wherein the metal object is a ferrous metal object.

* * * * *